US005647594A

United States Patent [19]

Pesquié

[11] Patent Number: 5,647,594

[45] Date of Patent: Jul. 15, 1997

[54] VARIABLE GAME BOARD HAVING REVERSIBLE PAWNS

[76] Inventor: Jean Pesquié , 15 Rue Michel, 76130 Mont Saint Aignan, France

[21] Appl. No.: 412,459

[22] Filed: Mar. 29, 1995

[30] Foreign Application Priority Data

Mar. 30, 1994 [FR] France ..... 94 03764

[51] Int. Cl.[6] ..... A63F 3/00

[52] U.S. Cl. ..... 273/282.1

[58] Field of Search ..... 273/236, 282.1, 273/284, 291

[56] References Cited

U.S. PATENT DOCUMENTS

| | | | |
|---|---|---|---|
| 3,347,550 | 10/1967 | Carboni | 273/282.1 |
| 3,520,537 | 7/1970 | Peebles | 273/282.1 X |
| 3,531,122 | 9/1970 | Peebles | 273/281.1 |
| 3,761,093 | 9/1973 | Migliore | 273/282.1 X |
| 4,032,152 | 6/1977 | Schifman | 273/284 |
| 4,529,206 | 7/1985 | Curry et al. | 273/282.1 X |
| 4,657,259 | 4/1987 | Smith et al. | 273/282.1 X |
| 4,984,807 | 1/1991 | Shiryon | 273/282.1 X |
| 5,048,840 | 9/1991 | Johnson | 273/282.1 X |
| 5,087,052 | 2/1992 | Simon | 273/284 |

FOREIGN PATENT DOCUMENTS

| | | |
|---|---|---|
| 2445732 | 8/1980 | France . |
| 2508329 | 12/1982 | France . |
| 5604073 | 3/1988 | France . |
| 6401861 | 8/1965 | Netherlands . |
| 1128472 | 9/1968 | Sweden . |
| 512541 | 10/1939 | United Kingdom . |

*Primary Examiner*—William E. Stoll
*Attorney, Agent, or Firm*—L. Lee Humphries

[57] ABSTRACT

The invention relates to indoor games of the thought-game type including a board with dual aspect cells: an active position and an inert one. According to the invention, it includes a frame 1 with cells where removable pawns 2 are in one of two positions, allowing to define a particular playing board of the game. In active position, the pawns can have two different characteristic aspects and change from one to another during the course of the game. In order to play, there is no need to shift a pawn from one cell to another one: changing the aspect of pawns is the way to play QUISCO®.

FIG. 1 is appended to the abstract.

8 Claims, 4 Drawing Sheets

VARIABLE GAME BOARD HAVING REVERSIBLE PAWNS

This invention relates to a variable game board, with non-slidable, reversible pawns. In the preferred embodiment, them is also included removable, covering caps, each of which fits over a button or protrusion of other shape, on one side of each of the pawns.

Numerous game of thought are known. They generally are comprised of boards and games pieces that are moved on the board during the game; for instance, such games are chess, checkers and so on.

The invention aims at proposing a device which allows to develop a game of thought, which is played on a board, and for which the progress of the game does not require any shift of one pawn from one playing square, or, rather, one playing cell, which may or may not be square, to another playing cell. The name of such a game as well as the game board is QUISCO® (trademark).

The invented set for playing a QUISCO® game is a board with dual-aspect cells. One aspect of the cell is an active one, the other aspect is an inactive one. The QUISCO® game includes cells which receive reversible pawns which turn the cells into active or inactive aspects. Thus can be defined a particular board for playing QUISCO® games. Thus, the cells can present two different and typical aspects and can change from one to another during the game.

Other characteristics and advantages of this invention will appear in the following description and drawings.

FIG. 1 is a schematic partial cross-section of the left upper corner of the QUISCO® game board set according to a first version of a first implementation of a board embodying the invention.

The cross section of FIG. 1 is taken on line 1—1 of FIG. 2.

FIG. 6 is taken on line 6—6 of FIG. 7.

Figure 8:
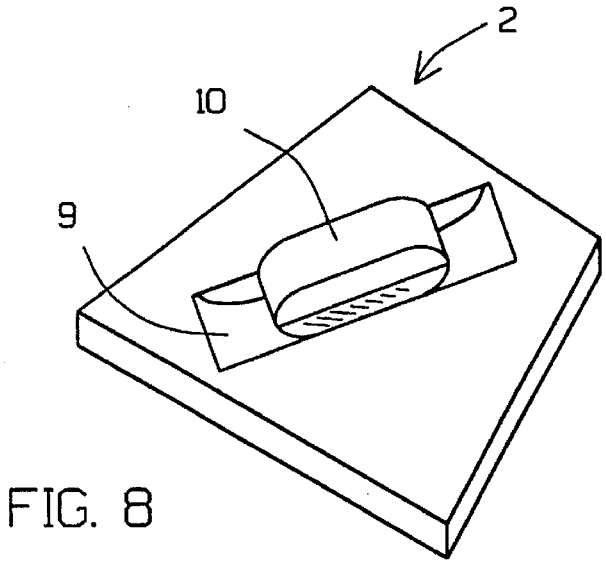

FIG. 8 displays a new type of reversible pawn and a new type of reversible cap.

Figure 9:
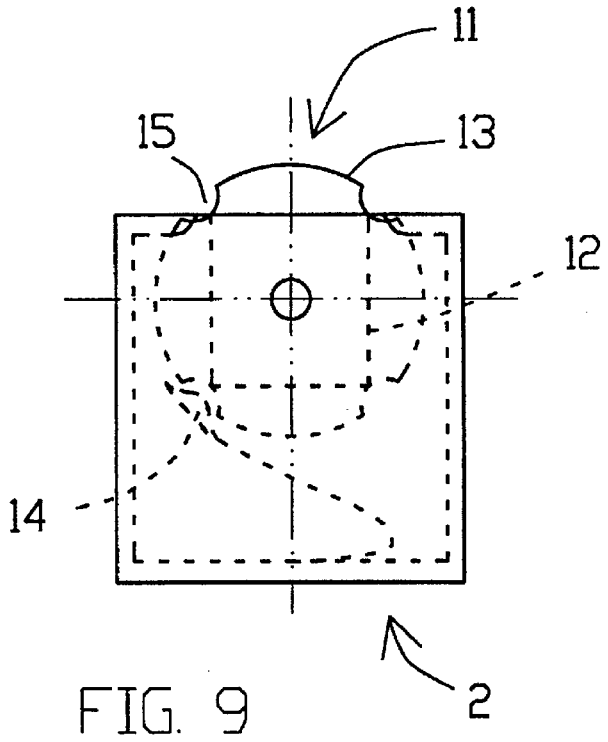

FIG. 9 is a side view of a cubical pawn and a rotating device partially within the cubical pawn.

Figure 10:
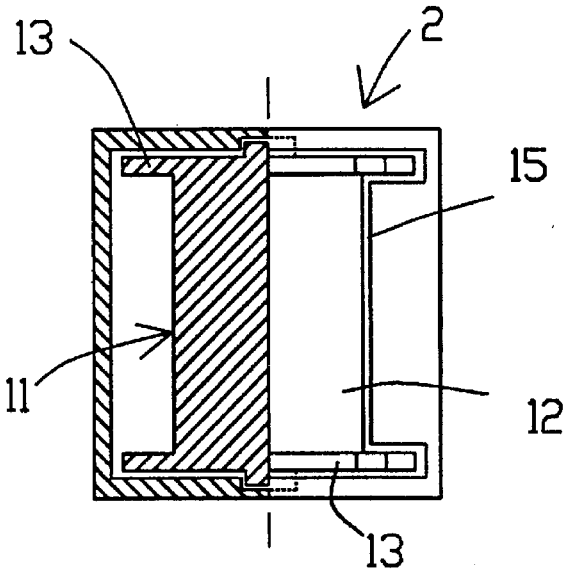

FIG. 10 is a top view, in partial section, of the cubical pawn of FIG. 9.

Figure 11:
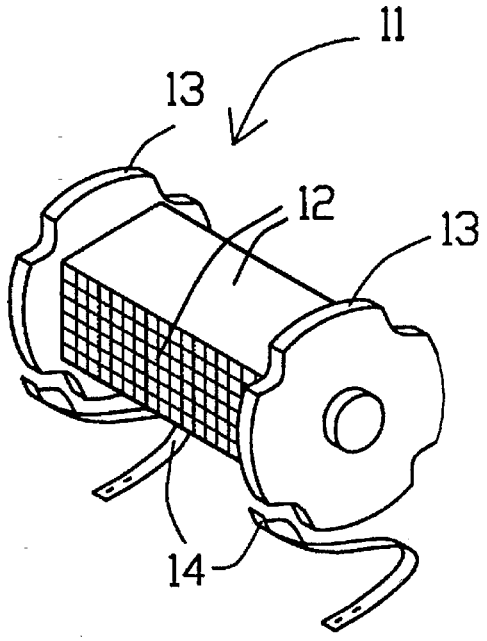

FIG. 11 is a perspective of the rotating device of FIGS. 9 and 10.

The invention named relates to a kind of indoor game board used in "games of thought" such game board mainly consists of a main frame 1, including cells which can have two aspects, an active one and an inactive one. In the invention, the frame 1 includes square cells, which receive reversible pawns 2. When the square cell is active, the reversible pawns show two different typical aspects and change from one aspect to another during the course of the game.

In a first implementation, a reversible pawn 2 includes a base 8 with an active and an inert side. The active side shows a button 6. In one characteristic aspect of the pawn, the button is uncovered. In another characteristic aspect, the button 6 is covered with a marking cap 3.

Figure 1:
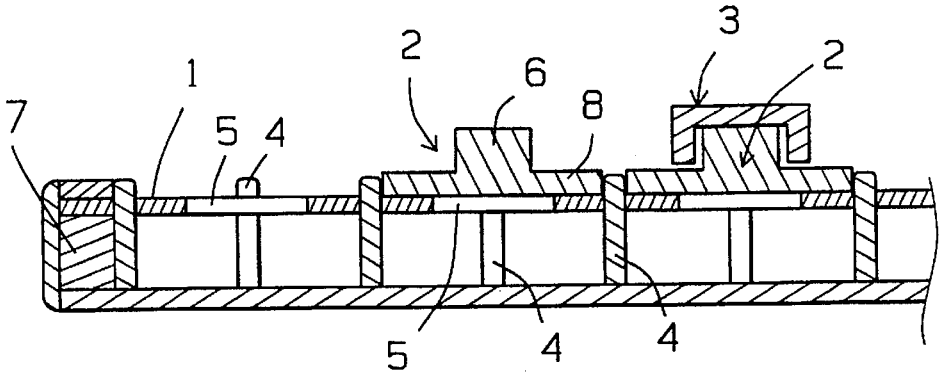
Figure 2:
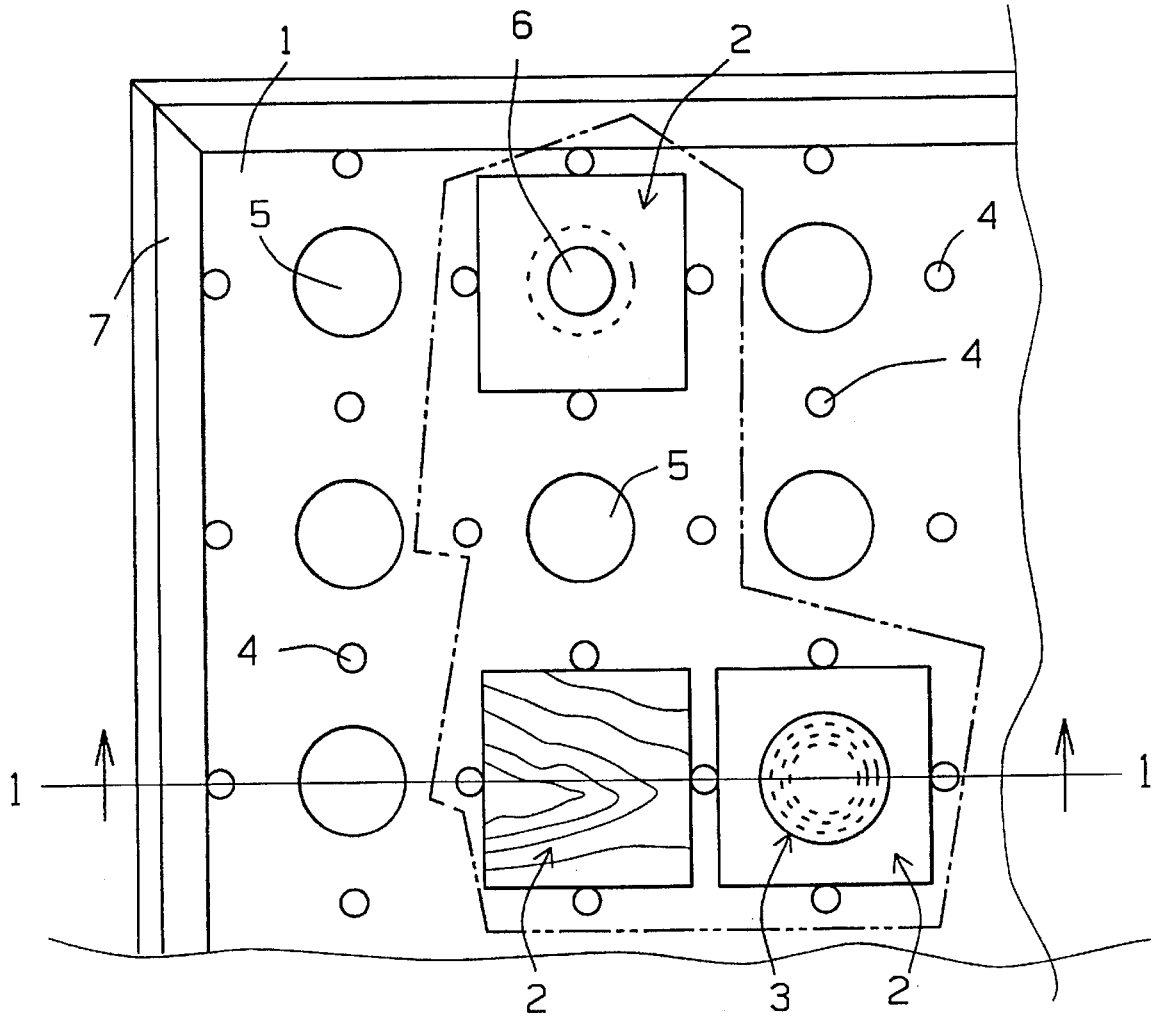
FIG. 2 is a top-view of the same corner as FIG. 1.

The FIGS. 1 and 2 show the left upper corner of the frame 1, with a cut-view and a top-view, with only three pawns 2, one of them has a marking cap on it, according to a first quadrangular example of the first implementation of the invention.

Figure 6:
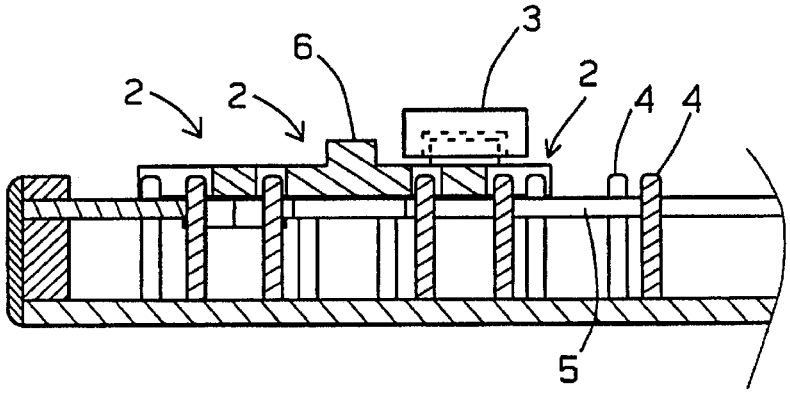
FIG. 6 is a cross-section of a second embodiment of the game board embodying the invention.
Figure 7:
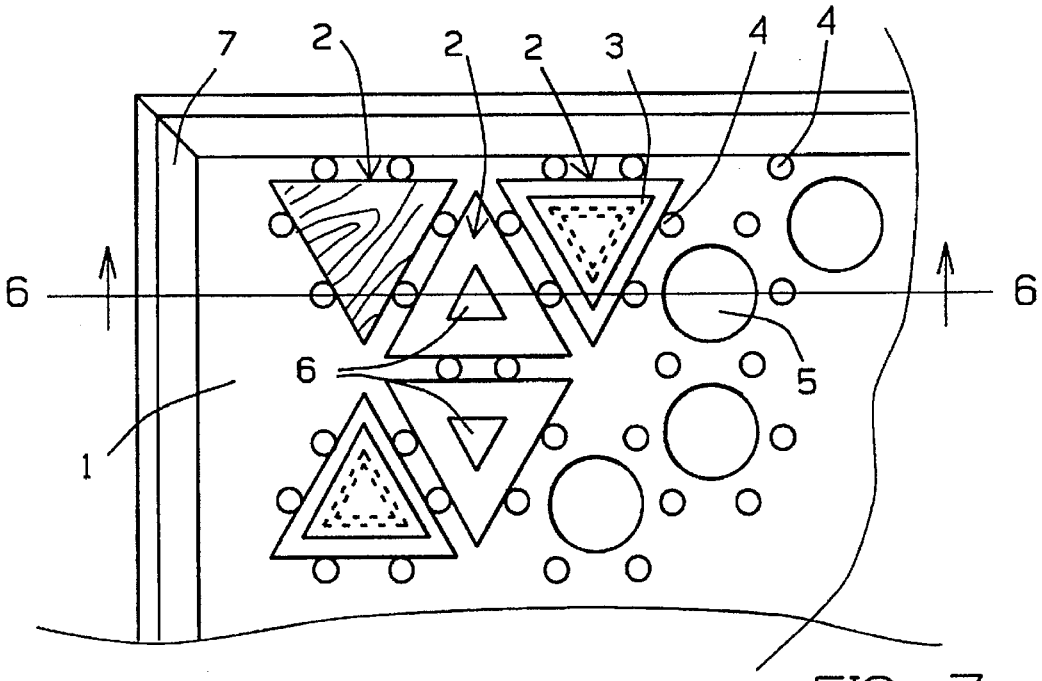
FIG. 7 is a top-view of the same corner as FIG. 6.

FIGS. 6 and 7 present a second triangular example of the same implementation of the invention.

The frame 1 is a device, the general shape of which is determined by the shape chosen for the pawns and the square cells, and by their number. The frame 1 is hollowed so that it can receive the button 6 of the pawns 2. The lower and upper plates of the frame 1 are joined by swivels or longitudinal spindles 4, of round or other shape in cross section, which protrudes above the upper plate by a height slightly below the top of the base 8 of a pawn 2. The arrangement of the swivels or longitudinal spindles 4, which may be of various shape in cross section, but which spindles 4 define, or outline, the cells which receive the pawns 2 and provide easy handling of them. It may be seen that the location of the longitudinal spindles 4 are of importance, while their individual cross section shape, round or otherwise, is of relative unimportance. The swivels, or spindles 4 are only a part of the cells, the second part is constituted by an aperture 5 through the upper plate of the frame 1. The position of the aperture 5 relative to the swivels 4 and the shape of aperture 5 are related to the shape and the size chosen for the buttons 6 of the pawns 2. The two plates of the frame 1 are girdled by a fringe 7 insuring proper closure and stiffness of the frame 1 with the aid of the swivels or spindles, 4.

Any number of cells is possible for a given realization of the invention. The number of cells is only limited by the overall dimension of the device. The arrangement of the cells of the frame 1 is designed in such a way that all the pawns are placed edge to edge. Having in mind that a pawn for a game may be a polygon of any shape (triangular, quadrangular, hexagonal) with several edges, the expression "edge to edge" precisely means that each pawn has, at least, one edge next to one edge of another pawn. The pawns 2 have a base 8 topped, on one side, by a button 6. As may be seen in FIG. 7, the button 6 may be of other shape than cylindrical. Also, as seen from FIGS. 3 and 7, the button 6 may or may not be of shape similar to the base 8 of the pawn 2.

Figure 3A:
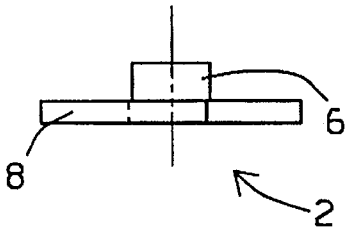
FIG. 3A is a front view of the reversible pawn of FIG. 3.
Figure 3:
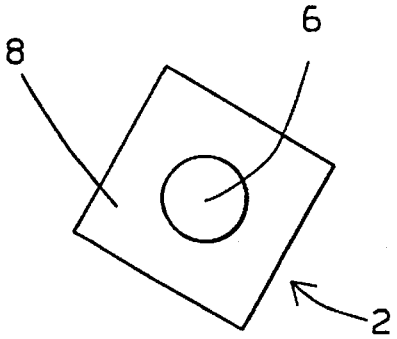
FIG. 3 is a top view of the reversible pawn of FIGS. 1 and 2.

FIG. 3 shows a pawn with a quadrangular base and a cylindrical button. FIG. 3A is a front view of the pawn 2, showing the button, or protrusion, 6 extending above the base 8. In the embodiment displayed in FIGS. 6 and 7, the base 8 and the button both have a triangular shape. It can be seen that the sides of the button 6 are parallel to the sides of the base 8 of the pawn 2.

The reversible pawns 2 have to be put into cells of the frame 1, with the inactive up or down but always between swivels, or spindles 4.

When the active side is up, the cell is said active. The button 6 of the pawn 2 is then on the top side.

When the inert side is up, the cell is said not active. The button 6 of a pawn 2 is then concealed and lies within an aperture 5 of the frame 1. In the preferred use of the game board, only the active cells constitute the board of a particular QUISCO® game.

The inert inactive cells, that is, the cells in which the pawn's inactive side is up, can be called "dark cells", like in a cross-word game, or they can be considered to be "dead cells" for a particular QUISCO® game, even if they are still cells for the frame 1. Thanks to the reversibility of the pawns, different boards to play QUISCO® can be realized on the same frame 1.

Figure 4A:
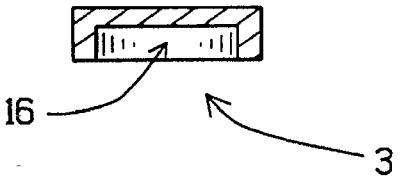
FIG. 4A is a partial cross section front view of the marking cap of FIG. 4.
Figure 4:
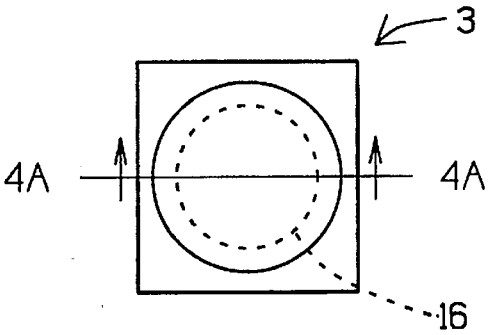
FIG. 4 is a top view of a marking cap of FIGS. 1 and 2.

A marking cap 3 is are shown in a top-view in FIG. 4 and the marking cap 3 is shown in FIG. 4A in partial cross section taken on line 4A—4A of FIG. 4. FIG. 4A shows the cap 3 to have a cavity 16 which allows cap 3 to fit over button 6. The size and shape of the caps 3 are such that they can cover the buttons, be easily taken off without carrying away the reversible pawn on the button of which they are placed. The difference between a pawn with a capped button and one with an uncovered button can be emphasized, for example, by using contrasting colors for the button 6 and the cap 3. In the mode of realization described herein, the absence or the presence of the cap 3 provides the two possible aspects of a pawn when the pawn's active side is showing and, thus, the cell is active, during the course of a QUISCO® game.

This particular embodiment is one in which one of the aspects, the uncovered button 6, is physically linked to the base 8 of the pawn 2, whereas another embodiment is obtained by a reversible playing piece 10 in a depression, or cavity, 9 as shown in FIG. 8 the other one is obtained. Thus, the invention is not limited to use of caps 3. The invention extends to any other form that insures the general characteristics required to play the game; namely, pawns which turn the cells into active or inactive cells and means providing two different aspects when the cell is active.

In the particular embodiment of the invention shown in FIG. 8, the pawn 2 has a depression 9 into which fits playing piece 10. This playing piece 10 has two different sides, in order to provide the two aspects of a pawn 2, when it is active. The playing piece 10 has a different color shape, picture or other distinguishing feature, on each side and is easily reversible, as shown in FIG. 8.

Figure 5:
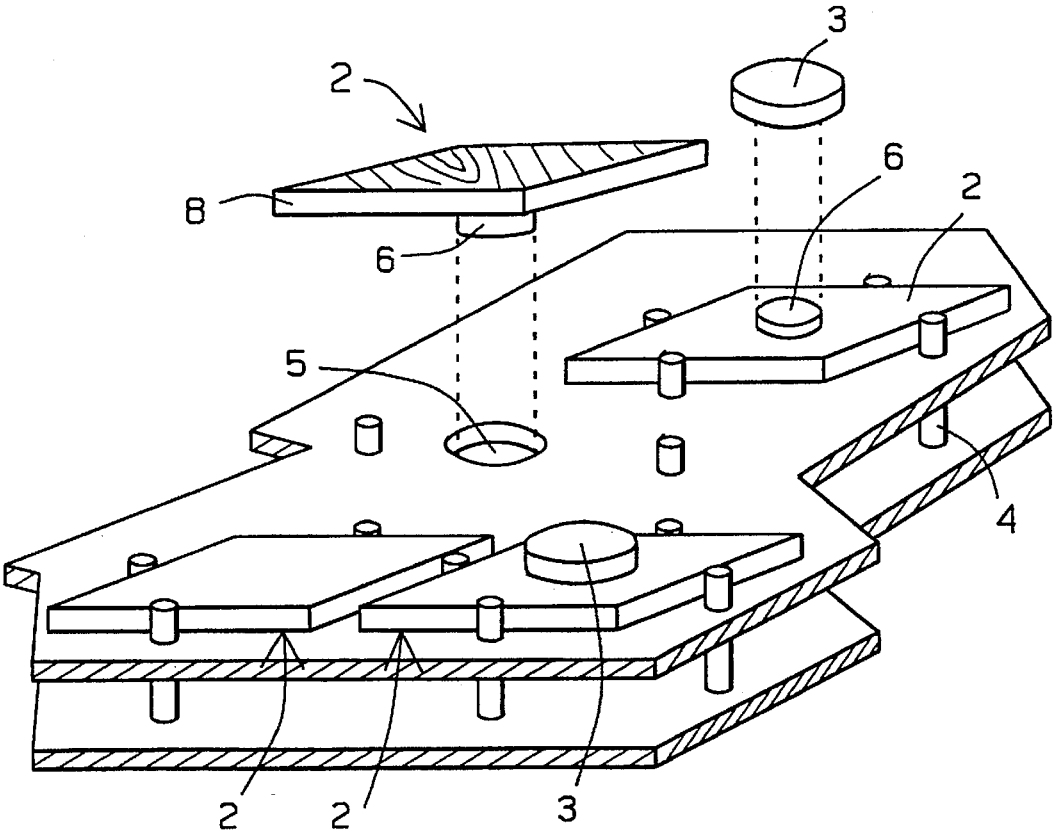
FIG. 5 is a three-dimensional view of a portion of the game board lying within the dashed and dotted lines of FIG. 2.

FIGS. 9, 10 and 11 show one implementation of the invention in which the pawn 2 is a kind of cubic box. One side is flat and dark. If this side is up, the cell is inert or inactive. On the opposite side, there is a window 15 through which one of the four faces 12 of a rotating device 11 can successively appear, managed by wheels 13, each with four catches and their blocking springs 14. The catches have two functions: to manage and to block the rotating device 11 placed into the hollowed pawn 2. The four faces 12 appear, one after the other, through the window 15 of the upper side of the pawn 2 in active position. As two opposite faces 12 have the same aspect but different from the other opposite faces, whatever direction the rotating device 11 is given when it turns, only two different aspects appear successively through the window 15, as required by the invention. The apertures 5 of the game board would, of course, receive the exposed portion of the wheels 13 of the cubic box pawn 2 of this embodiment. Thus, rotating the device 11 to alternate faces represents, or is the equivalent of, adding and removing the cap 3 in the embodiment of FIG. 5. In this mode, swivels 4 may be shaped in cross-section as angular wedges attached to the frame 1 or to the pawns 2.

I claim:

1. A game board comprised of a frame having a plurality of cells each adapted to receive and hold a reversible pawn in either of its reversible positions, wherein is included a plurality of said pawns, each of said pawns having a protrusion which shows in one of said positions and is concealed in the other of said positions, and wherein is included a plurality of caps adapted to cover said protrusions on said pawns when said protrusions are showing and wherein said cells are bounded by spindles.

2. The game board of claim 1 wherein each of said cells has an aperture to receive said protrusion of each of said pawns.

3. The game board of claim 2 wherein said cells are bounded by spindles which extend out of said game board and wherein said spindles extend above said game board.

4. The game board of claim 1 wherein each of said pawns is configured to fit in said cells which are bounded by said spindles.

5. The game board of claim 1 wherein each said pawn, when in a cell, is precluded from shifting laterally by said spindles which bound each said cell.

6. The game board of claim 1 wherein each of said caps has a cavity therein to receive said protrusions, said protrusions precluding said caps from shifting laterally when said caps are placed on said protrusions.

7. The game board of claim 1 wherein each said cell comprises an aperture in said game board, and wherein each said aperture is adapted to receive said protrusion of each said pawn.

8. The game board of claim 7 wherein each said pawn is comprised of a flat base having two opposing sides and said protrusion is disposed on one of said sides.

* * * * *

UNITED STATES PATENT AND TRADEMARK OFFICE

CERTIFICATE OF CORRECTION

PATENT NO. : 5,647,594

DATED : July 15, 1997

INVENTOR(S) : Jean Pesquié

It is certified that error appears in the above-indentified patent and that said Letters Patent is hereby corrected as shown below:

Column 1, line 6, "them" should be --there--; same column, line 9, "game" should be --games--; same column, line 10, "games" should be --game--; same column, line 60 should read --board used in "games of thought". Such game board mainly--.

Throughout the description, "QUISCO®" should be, --QUISCO™--.

(NOTE--No circle is to be placed around the superscript "™".)

Column 3, line 6, delete "are"; same column, line 25, place a period after "Fig. 8" and delete "the other one is obtained."

Signed and Sealed this

Thirtieth Day of September, 1997

*Attest:*

Bruce Lehman

BRUCE LEHMAN

*Attesting Officer*

*Commissioner of Patents and Trademarks*